US006173766B1

(12) United States Patent
Nakamura et al.

(10) Patent No.: US 6,173,766 B1
(45) Date of Patent: Jan. 16, 2001

(54) INTEGRATED HEAT EXCHANGER

(75) Inventors: Katsumi Nakamura; Michitake Sumida, both of Tokyo (JP)

(73) Assignee: Calsonic Kansei Corporation, Tokyo (JP)

( * ) Notice: Under 35 U.S.C. 154(b), the term of this patent shall be extended for 0 days.

(21) Appl. No.: 09/013,221

(22) Filed: Jan. 26, 1998

(30) Foreign Application Priority Data

Jan. 24, 1997 (JP) ..... 9-010759

(51) Int. Cl.[7] ..... F28B 7/06

(52) U.S. Cl. ..... 165/176; 165/140; 165/148; 165/153; 123/196 AB; 123/41.1

(58) Field of Search ..... 165/179, 140, 165/148, 175, 135, 153, 176; 123/41.1, 196 AB; 184/104 B

(56) References Cited

U.S. PATENT DOCUMENTS

| | | | | |
|---|---|---|---|---|
| 1,948,929 | * | 2/1934 | MacPherson | 165/140 |
| 4,190,105 | * | 2/1980 | Dankowski | 165/179 |
| 4,947,931 | * | 8/1990 | Vitacco | 165/140 |
| 5,000,257 | * | 3/1991 | Shinmura | 165/140 |
| 5,009,262 | * | 4/1991 | Halstead et al. | 165/140 |
| 5,033,540 | * | 7/1991 | Tategami et al. | 165/140 |
| 5,186,244 | * | 2/1993 | Joshi | 165/140 |
| 5,526,873 | * | 6/1996 | Marsais et al. | 165/140 |

FOREIGN PATENT DOCUMENTS

| | | |
|---|---|---|
| 195 09 654 | 9/1996 | (DE) . |
| 0 237 675 | 9/1987 | (EP) . |
| 0 431 917 | 6/1991 | (EP) . |
| 0 789 213 | 8/1997 | (EP) . |
| 1-247990 | 10/1989 | (JP) . |

* cited by examiner

*Primary Examiner*—Ira S. Lazarus
*Assistant Examiner*—Terrell McKinnon
(74) *Attorney, Agent, or Firm*—Sughrue, Mion, Zinn, Macpeak & Seas, PLLC

(57) ABSTRACT

An integrated heat exchanger includes a radiator having a core formed between a pair of radiator tanks, a condenser adjoining the radiator and having the core formed between a pair of condenser tanks, and a corrugated fin provided in the core and shared between the radiator and the condenser, the heat exchanger containing first partitions which divide the inside of the pair of condenser tanks to thereby create fluid chambers on one side of the respective condenser tanks in such a way as to become opposite to each other; and a fluid inflow pipe and a fluid outflow pipe connected to the fluid chamber of the condenser tanks.

7 Claims, 6 Drawing Sheets

INTEGRATED HEAT EXCHANGER

BACKGROUND OF THE INVENTION

1. Field of the Invention

The present invention relates to an integrated heat exchanger comprising a radiator adjoining a condenser, and corrugated fins provided in a core formed between the radiator and the condenser and is shared between them.

2. Description of the Related Art

There has recently been developed a so-called integrated heat exchanger comprising a condenser for cooling purposes which is joined to the front surface of the radiator.

FIG. 6 shows an integrated heat exchanger of this type, wherein a condenser 1 is provided in front of a radiator 2.

The condenser 1 comprises an upper condenser tank 3 which is spaced a given distance away from and is opposite to a lower condenser tank 4, and a core 5 formed between the upper and lower condenser tanks 3, 4. The radiator 2 comprises an upper radiator tank 6 which is spaced a given distance away from and is opposite to a lower radiator tank 7, and the core 5 formed between the upper and lower radiator tanks 6, 7.

In this integrated heat exchanger, tubes 8 for use with the condenser and tubes 8 for use with the radiator are provided in the core 5. Wide corrugated fins 9 are mounted so as to extend over the tubes 8 by brazing and is shared between the condenser 1 and the radiator 2.

A cooling water inflow pipe 10 is connected to the upper radiator tank 6 of the radiator 2, and a cooling water outflow pipe 11 is connected to the lower radiator tank 7.

Further, a coolant inflow pipe 12 and a coolant outflow pipe 13 are connected to the upper condenser tank 3 of the condenser 1.

In this integrated heat exchanger, a fluid cooler 14 for cooling an automatic transmission fluid is housed in the lower radiator tank 7.

This fluid cooler 14 comprises an inner fin 17 sandwiched between an outer cylinder 16 and an inner cylinder 15. The outer cylinder 16 is connected at one longitudinal end to a fluid inflow pipe 19 via a seat member 18 and is connected at the other longitudinal end to a fluid outflow pipe (not shown) via the seat member 18.

The fluid inflow pipe 19 and the fluid outflow pipe are respectively inserted into through holes 7*a* formed in the lower radiator tank 7, and the seat members 18 are caulked onto and brazed to the respective through holes 7*a*.

However, since the fluid cooler 14 is additionally housed in the lower radiator tank 7, the forgoing existing integrated heat exchanger suffers the problem of an increase in the number of components and man-hours required to assemble the heat exchanger.

Further, before the fluid cooler 14 is housed in the lower radiator tank 7, the inner fin 17 is interposed between the inner cylinder 15 and the outer cylinder 16. While the seat members 18 are attached to the outer cylinder 16, these components must be brazed to each other. For these reasons, the integrated heat exchanger suffers another problem of an increase the number of man-hours required to braze the components together.

SUMMARY OF THE INVENTION

The present invention is intended to solve the foregoing problems, and the object of the present invention is to provide an integrated heat exchanger which enables a fluid cooler to be readily and reliably formed.

According to the present invention, there is provided an integrated heat exchanger comprising: a pair of radiator tanks; a pair of condenser tanks respectively adjoining the pair of radiator tanks; a core provided between the pair of radiator tanks and between the pair of condenser tanks so as to be shared between the radiator tanks and the condenser tanks; and a pair of first partitions provided insides of the pair of condenser tanks so as to be opposed to each other and divide insides of the pair of condenser tanks thereby creating a pair of fluid chambers on one side of the respective condenser tanks, whereby a fluid flows through the fluid chambers and the core independently from a coolant flowing through the pair of condenser tanks and the core.

The above integrated heat exchanger preferably includes a fluid inflow pipe and a fluid outflow pipe connected to one of the fluid chambers of the condenser tanks.

Further, the above integrated heat exchanger preferably includes a second partition for dividing one of the fluid chambers into first and second sub-divided fluid chambers, wherein the fluid inflow pipe is connected to the first sub-divided fluid chamber, and the fluid outflow pipe is connected to another sub-divided fluid chamber.

Still further, the second sub-divided fluid chamber is closer to the first partition than the first sub-divided fluid chamber.

In the integrated heat exchanger according to the present invention, the pair of condenser tanks are respectively divided by the first partitions, thereby forming fluid chambers, which will serve as a fluid tank of a fluid cooler, in a part of the condenser tanks.

The fluid inflow and outflow pipes are connected to the fluid chamber, and a part of the core of the condenser is used as the core of the fluid cooler.

Further, the fluid chamber of one of the condenser tanks is further divided into sub-divided fluid chambers by means of the second partition. The fluid inflow pipe is connected to one of the sub-divided fluid chambers, and the fluid outflow pipe is connected to the other sub-divided fluid chamber.

Still further, the fluid outflow pipe through which a cooled fluid flows outside is connected to the fluid chamber formed by the first partition.

DETAILED DESCRIPTION OF THE PREFERRED EMBODIMENTS

Figure 1:
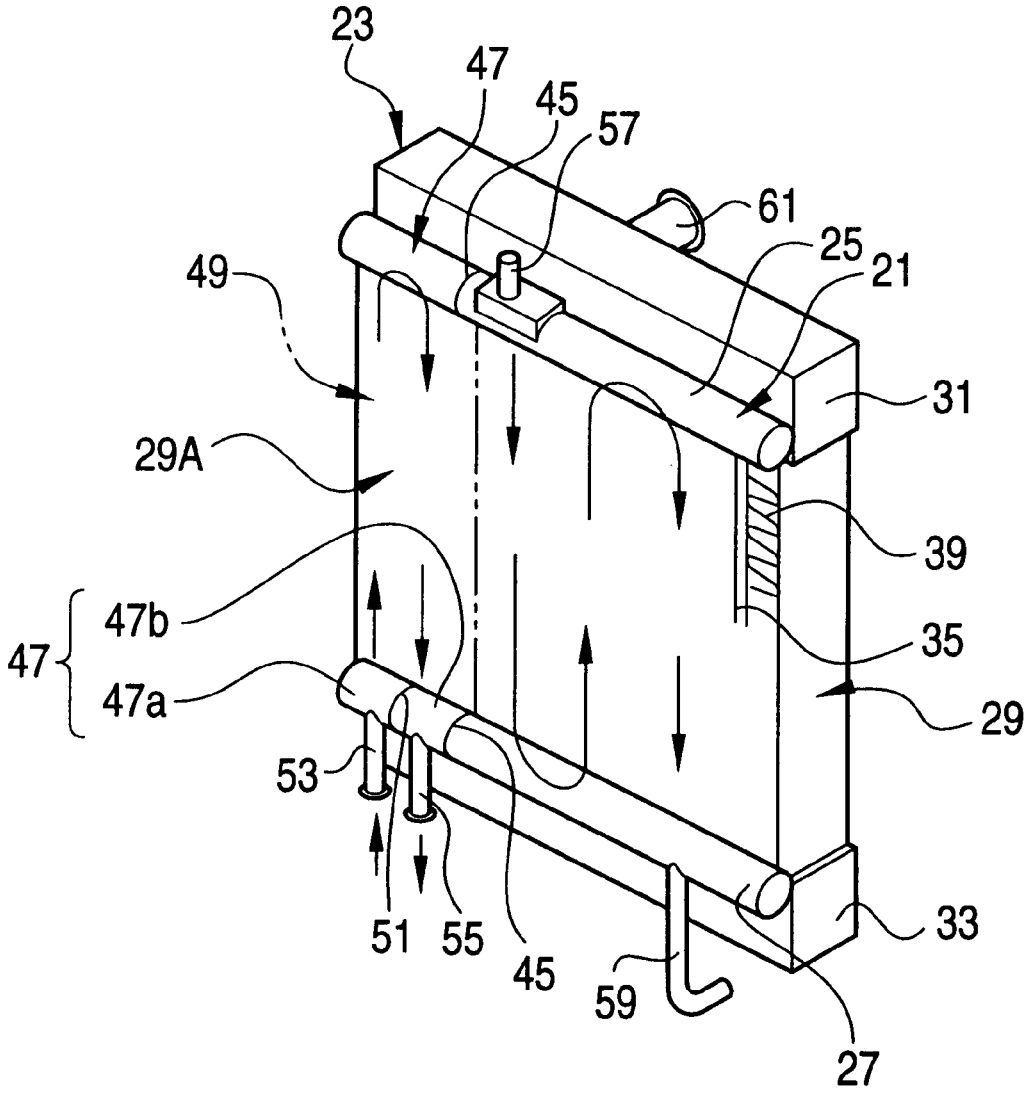
FIG. 1 is a perspective view showing an integrated heat exchanger according to one embodiment of the present invention.

By reference to the accompanying drawings, an embodiment of the present invention will be described in detail hereinbelow.

FIGS. 1 through 4 illustrate one embodiment of an integrated heat exchanger according to the present invention.

In this integrated heat exchanger, a condenser 21 is disposed in front of a radiator 23.

The condenser 21 comprises an upper condenser tank 25 which is spaced a given distance away from and is opposite to a lower condenser tank 27, and a core 29 provided between the upper and lower condenser tanks 25, 27.

The radiator 23 comprises an upper radiator tank 31 which is spaced a given distance away from and is opposite to a lower radiator tank 33, and the core 29 provided between the upper and lower radiator tanks 31, 33.

Figure 2:
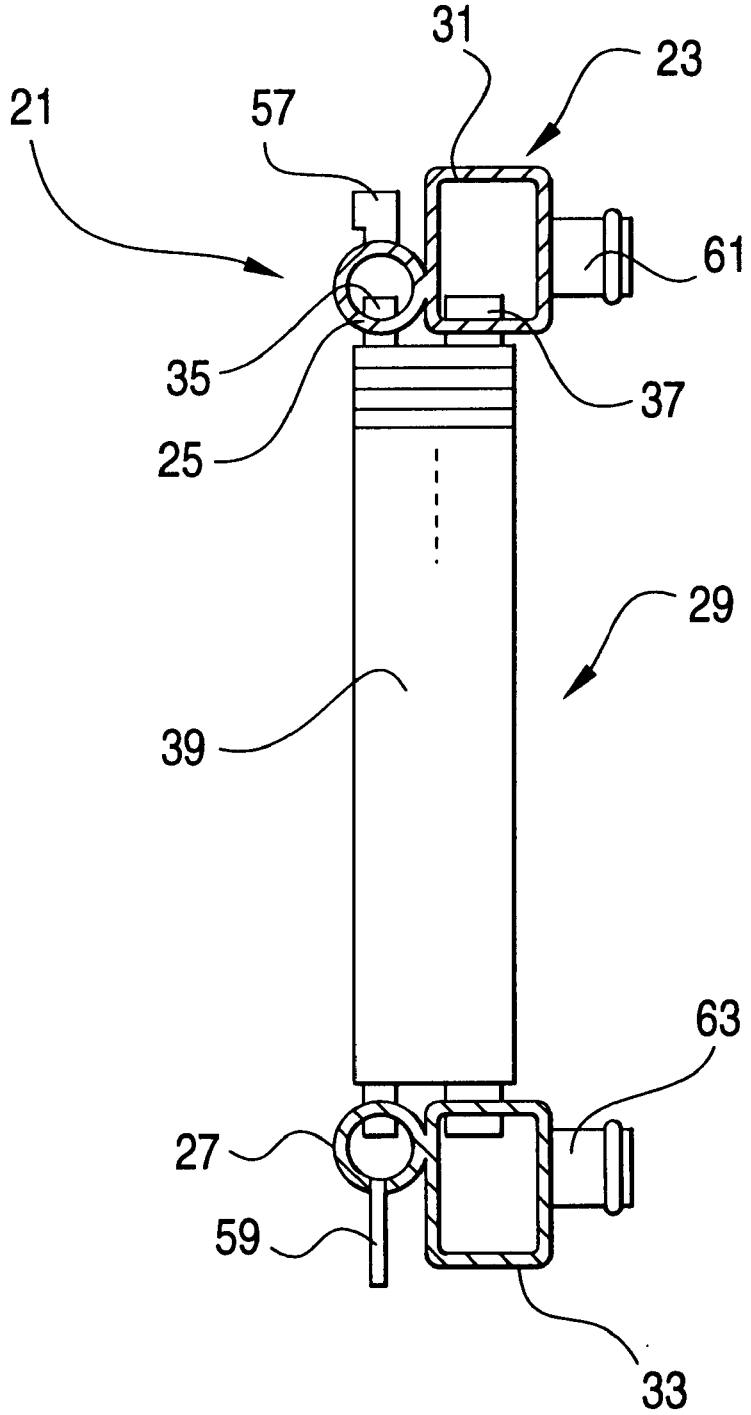
FIG. 2 is a transverse cross-sectional view showing the integrated heat exchanger shown in FIG. 1.

As shown in FIG. 2, tubes 35 for use with the condenser 21 and tubes 37 for use with the radiator 23 are provided in the core 29.

Wide corrugated fins 39 are mounted so as to extend over the tubes 35, 37 by brazing and is shared between the condenser 21 and the radiator 23.

In the present embodiment, the upper condenser tank 25, the upper radiator tank 31, the lower condenser tank 27, and the lower radiator tank 33 are integrally formed from aluminum by extrusion molding.

The upper and lower condenser tanks 25 and 27 are cylindrically formed, and the upper and lower radiator tanks 31, 33 are rectangularly formed.

Figure 4:
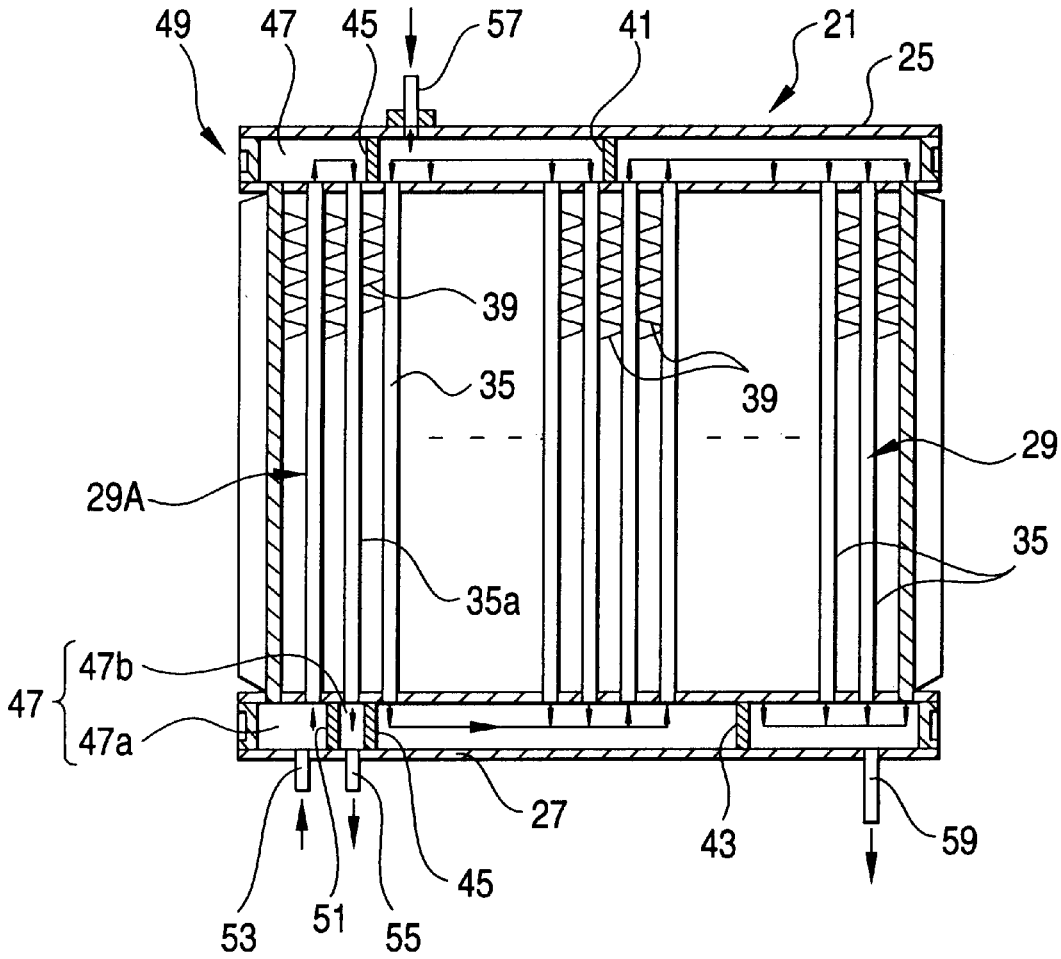
FIG. 4 is a longitudinal cross-sectional view showing a condenser shown in FIG. 1.

As shown in FIG. 4, a partition 41 is formed in the upper condenser tank 25, and a partition 43 is formed in the lower condenser tank 27.

In the present embodiment, the upper and lower condenser tanks 25, 27 are divided by means of first partitions 45, 45, to thereby form fluid chambers 47, 47 on one side of the respective upper and lower condenser tanks 25, 27.

In short, in the present invention, a part of each of the upper and lower condenser tanks 25 and 27 is formed into the fluid chamber 47 which serves as a fluid tank of a fluid cooler 49.

A core 29A of the fluid cooler 49 is formed between the fluid chambers 47, 47 through use of a part of the core 29 of the condenser 21.

Further, in the present embodiment, the fluid chamber 47 of the lower condenser tank 27 is divided into sub-divided fluid chambers 47*a*, 47*b* by means of a second partition 51.

A fluid inflow pipe 53 is connected to the sub-divided fluid chamber 47*a* formed between the longitudinal end of the lower condenser tank 27 and second partition 51, and a fluid outflow pipe 55 is connected to the sub-divided fluid chamber 47*b* formed between the first partition 45 and the second partition 51.

A coolant inflow pipe 57 is connected to the upper condenser tank 25 of the condenser 21 in the vicinity of the first partition 45. A coolant outflow pipe 59 is connected to the lower condenser tank 27. That is, the coolant inflow pipe 57 is provided closer to the fluid cooler 49 than the coolant outflow pipe 59. The temperature of the coolant which flows into the coolant inflow pipe 57 is higher than the temperature of the coolant which flows out the coolant outflow pipe 59. Generally, the temperature of the fluid is higher than the coolant. Therefore, the thermal influence exerted on the coolant of the condenser 21 by the fluid of the fluid cooler 49 can be reduced more as compared with the case that the coolant outflow pipe 59 is provided closer to the fluid cooler 49 than the coolant inflow pipe 57.

A cooling water inflow pipe 61 is connected to the upper radiator tank 31 of the radiator 23, and a cooling water outflow pipe 63 is connected to the lower radiator tank 33.

Figure 3:
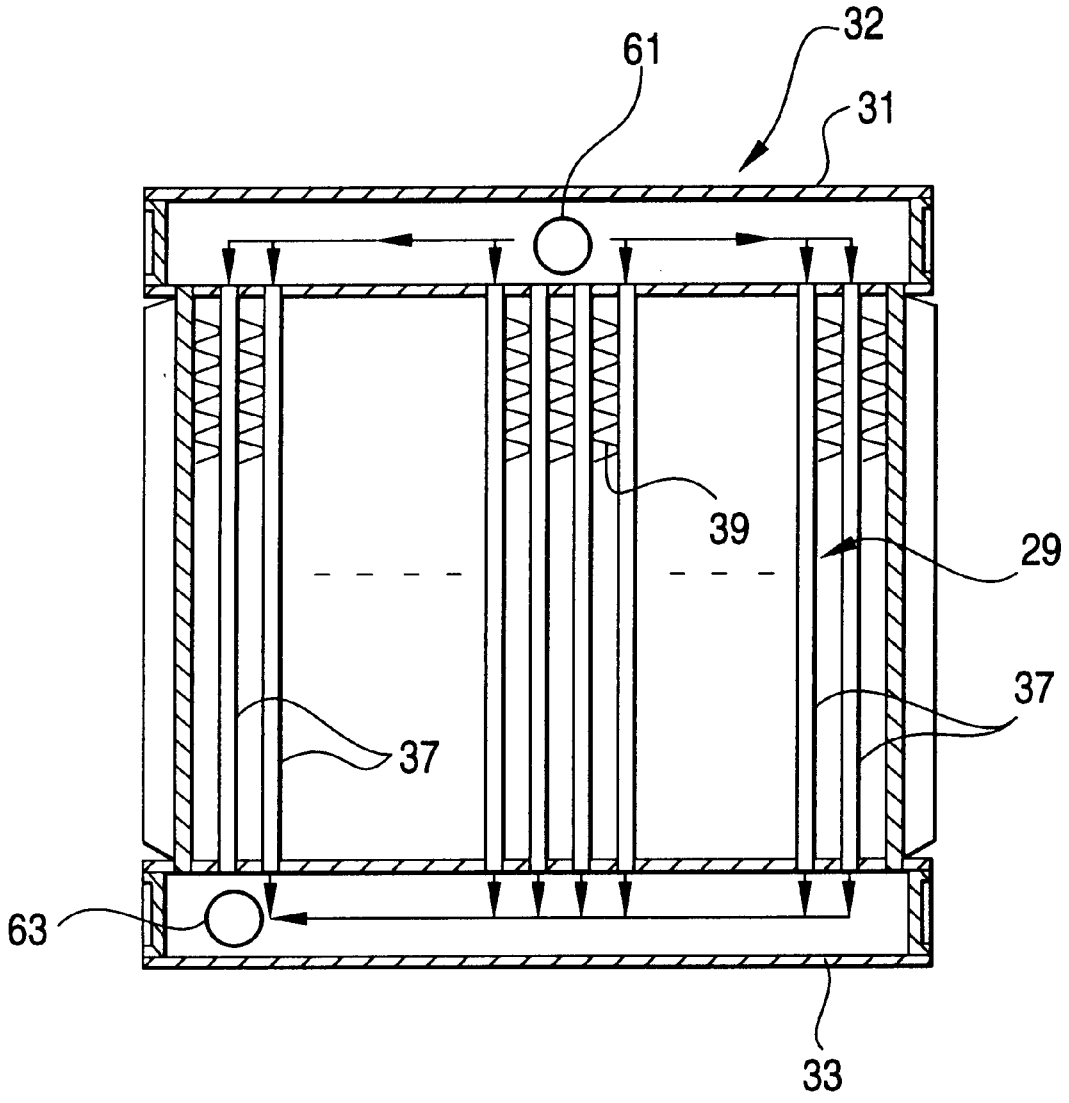
FIG. 3 is a longitudinal cross-sectional view showing a radiator shown in FIG. 1.

As shown in FIG. 3, in the foregoing integrated heat exchanger, the cooling water of the radiator 23 flows into the upper radiator tank 31 from the cooling water inflow pipe 61. After having been cooled during the course of flowing through the tubes 37, the cooling water flows into the lower radiator tank 33 and flows outside from the cooling water outflow pipe 63.

Further, as shown in FIG. 4, after having flowed into the upper condenser tank 25 from the coolant inflow pipe 57, the coolant of the condenser 21 flows into the lower condenser tank 27 by way of the tubes 35. The coolant flows into the upper and lower condenser tanks 25, 27 by action of the partitions 41, 43 and is cooled during the way of flowing through the tubes 35. Finally, the coolant flows outside from the coolant outflow pipe 59 of the lower condenser tank 27.

The fluid, which has flowed into the sub-divided fluid chamber 47*a* of the lower condenser tank 27 from the fluid inflow pipe 53, is cooled during the course of flowing through the tubes 35 and flows into the fluid chamber 47 of the upper condenser tank 25. Subsequently, the fluid is cooled during the course of flowing through the tubes 35 and flows into the sub-divided fluid chamber 47*b* of the lower condenser tank 27. The fluid then flows outside from the fluid outflow pipe 55.

In the integrated.heat exchanger having the foregoing configuration, the upper and lower condenser tanks 25, 27 are divided by the first partitions 45, 45 into the fluid chambers 47, 47 which are opposite to each other. Accordingly, the fluid chambers 47, 47, which serve as the fluid tank of the fluid cooler 49, are formed through use of a part of the upper and lower condenser tanks 25, 27. The fluid inflow and outflow pipes 53, 55 are connected to the fluid chamber 47 of the lower condenser tank 27. Further, since a part of the core 29 of the condenser 21 is used as the core 29A of the fluid cooler 49, the fluid cooler 49 can be readily and reliably formed.

Further, in the foregoing integrated heat exchanger, the fluid chamber 47 of the lower condenser tank 27 is divided into the sub-divided fluid chambers 47*a*, 47*b* by means of the second partition 51. The fluid inflow pipe 53 is connected to the sub-divided fluid chamber 47*a*, and the fluid outflow pipe 55 is connected to the sub-divided fluid chamber 47*b*. As a result, the fluid inflow and outflow pipes 53, 55 can be connected to the fluid chamber 47 of the lower condenser tank 27 in such a way as to be spaced apart from each other, thereby permitting fluid pipes to be readily routed.

In the aforementioned integrated heat exchanger, the fluid outflow pipe 55 is connected to the sub-divided fluid chamber 47*b* adjoining the first partition 45. Therefore, as shown in FIG. 4, the cooled fluid flows through a tube 35*a*, by way of the corrugated fins 39, adjoining the tube 35 through which the coolant of the condenser 21 flows. As a result, the thermal influence exerted on the coolant of the condenser 21 via the corrugated fins 39 can be reduced.

Although in the foregoing embodiment, the explanation has described the example in which the present invention is applied to a down-flow type integrated heat exchanger, the present invention is not limited to this embodiment. The present invention can also be applied to a cross-flow type integrated heat exchanger in which the coolant, cooling water and fluid flow in the lateral direction.

Figure 5:
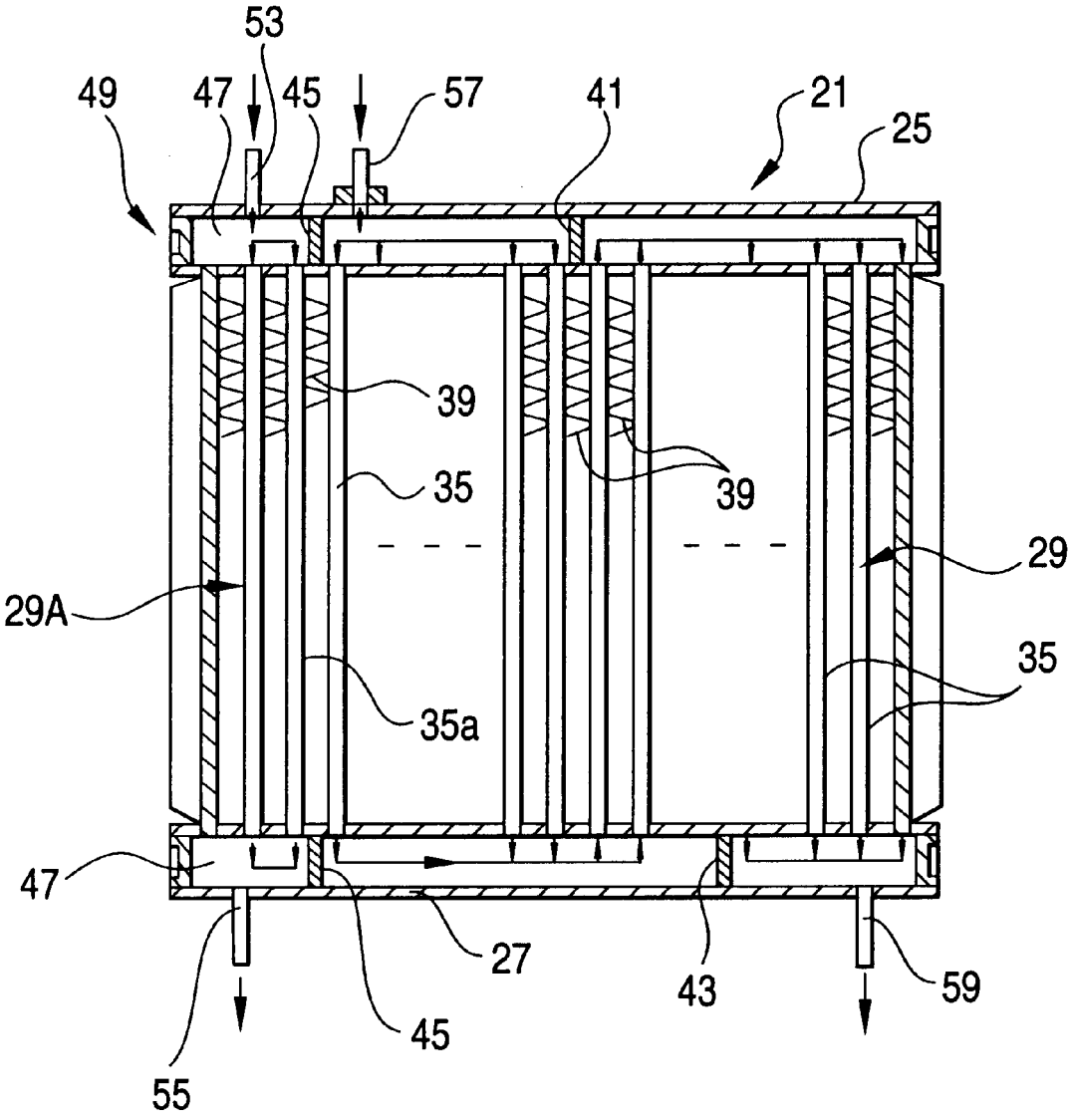
FIG. 5 is a longitudinal cross-sectional view showing a condenser according to another embodiment of the present invention.
Figure 6:
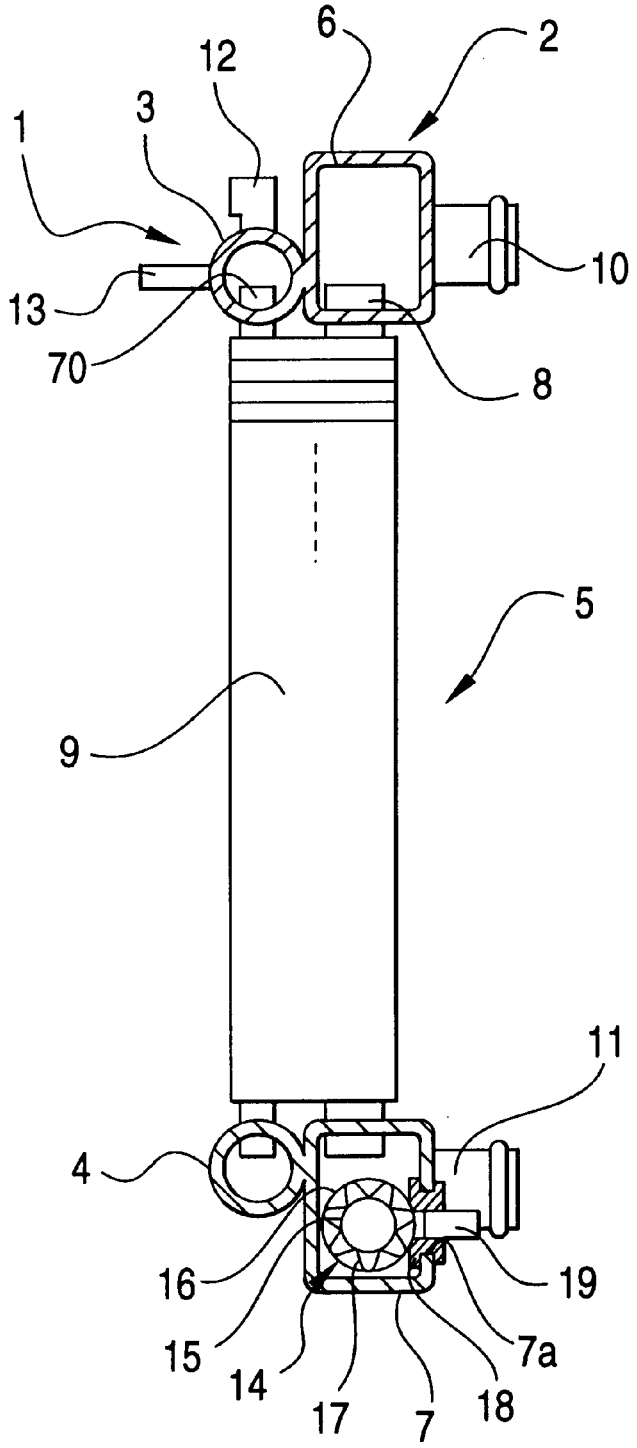
FIG. 6 is a transverse cross-sectional view showing an example of the integrated heat exchanger.

Further, in the foregoing embodiment, the explanation has described the example in which the fluid inflow and outflow pipes 53, 55 are connected to the fluid chamber 47 of the lower condenser tank 27. The present invention is not limited to such an embodiment. For example, the second partition 51 may be eliminated, and the fluid inflow pipe 53 may be connected to the fluid chamber 47 of the upper condenser tank 25 as shown in FIG. 5. The fluid outflow pipe 55 may be connected to the fluid chamber 47 of the lower condenser tank 27.

Further, in the foregoing embodiment, the explanation has described the example of the integrated heat exchanger which comprises the upper condenser tank 25 integrally formed with the upper radiator tank 31 and the lower condenser tank 27 integrally formed with the lower radiator tank 33. The present invention is not limited to such an embodiment and may be applied to an integrated heat exchanger which comprises an upper condenser tank separated from an upper radiator tank and a lower condenser tank separated from a lower radiator tank.

As has been described above, in the integrated heat exchanger according to the present invention, a pair of condenser tanks are divided into fluid chambers so as to become opposite to each other by the first partitions. Accordingly, the fluid chambers, which serve as a fluid tank of a fluid cooler, are formed through use of a part of the upper and lower condenser tanks. Fluid inflow and outflow pipes are connected to the fluid chamber. Further, since a part of a core of a condenser is used as a core of the fluid cooler, the fluid cooler can be readily and reliably formed.

Further, the fluid chamber of one of the condenser tanks is divided into sub-divided fluid chambers by means of a second partition. A fluid inflow pipe is connected to one of the sub-divided fluid chambers, and a fluid outflow pipe is connected to the other sub-divided fluid chamber. As a result, the fluid inflow and outflow pipes can be connected to the fluid chamber of one of the condenser tanks in such a way as to be spaced apart from each other, thereby permitting fluid pipes to be readily routed.

Still further, the fluid outflow pipe is connected to the sub-divided fluid chamber adjoining the first partition. Therefore, the cooled fluid flows through a tube, by way of the corrugated fin, adjoining the tube through which the coolant of the condenser flows. As a result, the thermal influence exerted on the coolant of-the condenser via the corrugated fin can be reduced.

What is claimed is:

1. An integrated heat exchanger comprising:

a pair of radiator tanks;

a pair of condenser tanks respectively adjoining said pair of radiator tanks; and a core provided between said pair of radiator tanks and between said pair of condenser tanks so as to be shared between said radiator tanks and said condenser tanks;

wherein each of said pair of condenser tanks has an inside divided by a first partition into (1) a fluid chamber through which a fluid flows and (2) a coolant chamber through which a coolant flows, whereby said fluid flows through said fluid chambers and said core independently from said coolant flowing through said coolant chambers and said core, said fluid and said coolant being different materials; and wherein a coolant inflow pipe is connected to either of said coolant chambers, a coolant outflow pipe is connected to either of said coolant chambers, and said coolant inflow pipe is provided closer to said fluid chambers than said coolant outflow pipe.

2. The integrated heat exchanger according to claim 1, further comprising a fluid inflow pipe and a fluid outflow pipe connected to one of said fluid chambers.

3. The integrated heat exchanger according to claim 2, further comprising a second partition dividing one of said fluid chambers into a first sub-divided fluid chamber and a second sub-divided fluid chambers;

wherein said fluid inflow pipe is connected to said first sub-divided fluid chamber, and said fluid outflow pipe is connected to said second sub-divided fluid chamber.

4. The integrated heat exchanger according to claim 3, wherein said second sub-divided fluid chamber is closer to said first partition than said first sub-divided fluid chamber.

5. The integrated heat exchanger according to claim 1, further comprising:

a fluid inflow pipe connected to one of said fluid chambers; and a fluid outflow pipe connected to another of said fluid chambers.

6. The integrated heat exchanger according to claim 4, wherein said coolant inflow pipe is connected to one of said coolant chambers, and said coolant outflow pipe is connected to another of said coolant chambers.

7. The integrated heat exchanger according to claim 5, wherein said coolant inflow pipe is connected to one of said coolant chambers, and said coolant outflow pipe is connected to another of said coolant chambers.

* * * * *